US005794822A

United States Patent [19]

Foster

[11] Patent Number: 5,794,822

[45] Date of Patent: Aug. 18, 1998

[54] RECIPROCATING FLUID PUMP WITH IMPROVED BOTTLE SEAL

[75] Inventor: Donald D. Foster, St. Charles, Mo.

[73] Assignee: Contico International, Inc., St. Louis, Mo.

[21] Appl. No.: 633,894

[22] Filed: Apr. 17, 1996

[51] Int. Cl.[6] ..... B67D 5/40

[52] U.S. Cl. ..... 222/383.1

[58] Field of Search ..... 222/380, 383.1, 222/321.7, 321.1, 341, 385, 372, 481, 481.5, 482; 239/333

[56] References Cited

U.S. PATENT DOCUMENTS

| | | | |
|---|---|---|---|
| 4,371,097 | 2/1983 | O'Neill . | |
| 4,519,527 | 5/1985 | Klaeger | 222/383.1 |
| 4,678,122 | 7/1987 | Riglietti | 222/383.1 X |
| 4,846,810 | 7/1989 | Gerber . | |
| 4,958,754 | 9/1990 | Dennis | 222/383.1 |
| 5,092,855 | 3/1992 | Pardes . | |
| 5,294,025 | 3/1994 | Foster . | |
| 5,305,783 | 4/1994 | Debush . | |
| 5,603,434 | 2/1997 | Von Shuckmann | 222/383.1 X |

FOREIGN PATENT DOCUMENTS

B-47899/90 4/1990 Australia .

WO 96/14938 5/1996 WIPO .

*Primary Examiner*—Kevin P. Shaver

*Attorney, Agent, or Firm*—Howell & Haferkamp, L.C.

[57] ABSTRACT

A manually operated reciprocating fluid pump for securement to a container's mouth. The fluid pump comprises a dispenser body, a closure cap, a seal assembly, and a priming check valve. The dispenser body has a pump mechanism, a discharge port, and a discharge liquid flow path providing fluid communication between the pump mechanism and discharge port. The closure cap is connected to the dispenser body and is configured for closing the mouth of the container. The seal assembly has a first portion and a second portion. The first portion is shaped and configured for preventing leakage between the closure cap and the mouth of the container when the closure cap closes the mouth of the container. The second portion has an intake port adapted for fluid communication with liquid contained in the container. The second portion of the seal assembly and the dispenser body define an intake liquid flow path providing fluid communication between the intake port and the pump mechanism. A check valve in the intake liquid flow path is configured for permitting fluid flow from the intake port to the pump mechanism and for checking fluid flow from the pump mechanism to the intake port. The second portion of the seal assembly comprises at least part of the check valve.

23 Claims, 2 Drawing Sheets

RECIPROCATING FLUID PUMP WITH IMPROVED BOTTLE SEAL

BACKGROUND OF THE INVENTION

This invention relates to manually-operated reciprocating fluid pumps such as pump-type trigger sprayers.

A trigger sprayer typically includes a dispenser body, a closure cap connected to the dispenser body for securing the trigger sprayer to the mouth of a container (or bottle), a dip tube depending from the dispenser body and configured for extending into the bottle, and a gasket for preventing leakage between the closure cap and the mouth of the container when the closure cap closes the mouth of the container.

The dispenser body has a manually operated pump which draws liquid up the dip tube from the bottle and dispenses it through a nozzle via a liquid flow path in the dispenser body. A priming check valve within the liquid flow path and upstream of the pump permits fluid flow from the container to the pump, but checks fluid flow from the pump back to the container. Another check valve within the liquid flow path and downstream of the pump permits fluid flow from the pump to the nozzle, but checks fluid flow from the nozzle to the pump.

A concern associated with such trigger sprayers is that a gasket occasionally falls out of its associated closure cap. A gasket might be pried out of its closure cap via a dip tube of another trigger sprayer while the trigger sprayers are being assembled and/or transported. If a gasket falls out of its associated trigger sprayer during assembly, the gasket could cause a shut-down of the assembly line until the defective trigger sprayer is located. Also, if a trigger sprayer is missing its gasket when connected to a bottle, then the liquid contents of the bottle may inadvertently leak therefrom.

Another concern associated with such a trigger sprayer is the cost of manufacture. A typical trigger sprayer is of relatively low cost. However, trigger sprayers with more pieces generally cost slightly more to produce than trigger sprayers with fewer pieces. Millions of trigger sprayers are sold each year for use in dispensing a wide variety of products. Because of the large volumes sold, a savings of even one cent per trigger sprayer is significant.

SUMMARY OF THE INVENTION

Among the several objects of the present invention may be noted the provision of an improved fluid pump; the provision of such a fluid pump which prevents its gasket (i.e., seal) from falling out of or being pried from its closure cap; the provision of such a fluid pump which has a minimum number of parts; the provision of such a fluid pump which is relatively low in cost; and the provision of such a fluid pump which is of relatively simple construction.

Generally, a manually operated reciprocating fluid pump of the present invention is adapted to be secured to a container's mouth. The fluid pump comprises a dispenser body, a closure cap, a seal assembly, and a priming check valve. The dispenser body has a pump mechanism, a discharge port, and a discharge liquid flow path providing fluid communication between the pump mechanism and discharge port. The closure cap is connected to the dispenser body and is configured for closing the mouth of the container. The seal assembly has a first portion and a second portion. The first portion is shaped and configured for preventing leakage between the closure cap and the mouth of the container when the closure cap closes the mouth of the container. The second portion has an intake port adapted for fluid communication with liquid contained in the container. The second portion of the seal assembly and the dispenser body define an intake liquid flow path providing fluid communication between the intake port and the pump mechanism. A check valve in the intake liquid flow path is configured for permitting fluid flow from the intake port to the pump mechanism and for checking fluid flow from the pump mechanism to the intake port. The second portion of the seal assembly comprises at least part of the check valve.

In another aspect of the present invention, a manually operated reciprocating fluid pump comprises a dispenser body, a closure cap, and a seal assembly. The dispenser body has a pump mechanism, a discharge port, and a discharge liquid flow path providing fluid communication between the pump mechanism and discharge port. The closure cap is connected to the dispenser body and is configured for closing the mouth of the container. The seal assembly has a first portion shaped and configured for preventing leakage between the closure cap and the mouth of the container when the closure cap closes the mouth of the container. The fluid pump further comprises a connector for securing the seal assembly to the dispenser body. The connector has a vent opening therethrough configured for providing fluid communication between atmosphere and the interior of the container when the closure cap closes the mouth of the container.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
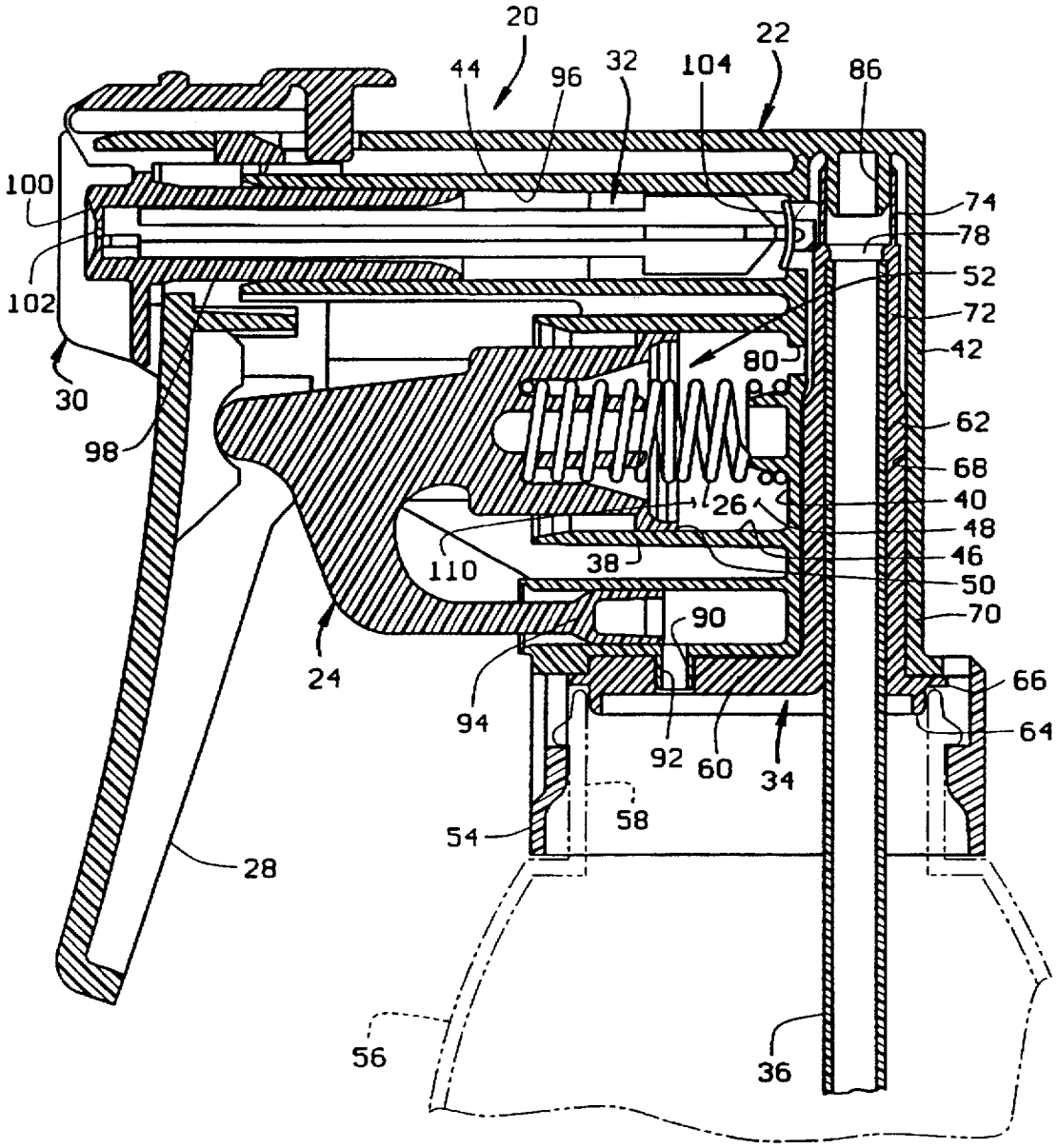
FIG. 1 is a side elevational view, in section, of a trigger sprayer of the present invention.

Referring now to the drawings, and first more particularly to FIG. 1, a trigger sprayer of the present invention is indicated in its entirety by the reference numeral 20. Preferably, the trigger sprayer 20 is made up of eight monolithic pieces: (1) a housing, generally indicated at 22; (2) a plunger, generally indicated at 24, (3) a coil spring 26, (4) a trigger 28; (5) a nozzle assembly, generally indicated at 30; (6) a spinner assembly, generally indicated at 32; (7) a seal assembly, generally indicated at 34; and (8) a dip tube 36. The housing 22 and plunger 24 constitute a dispenser body.

The housing 22 is preferably a single unitary piece and includes a cylindric wall 38, a circular back wall 40 substantially closing one end (i.e., the right end as viewed in FIG. 1) of the cylindric wall, a generally cylindric vertical formation 42 adjacent the circular back wall, and a horizontal tubular portion 44 extending forward from the vertical formation. The cylindric wall 38 includes a generally cylindric inner surface 46. The cylindric inner surface 46 of the cylindric wall 38 and the circular back wall 40 define a pump chamber, generally indicated at 48 open at one end (i.e., its left end as viewed in FIG. 1) for slidably receiving a piston head 50 of the plunger 24. The pump chamber 48, piston head 50, and spring 26 constitute components of a pump mechanism, generally indicated at 52.

The housing 22 includes a closure cap 54 at its lower end. The closure cap 54 is shaped for closing the mouth of a container, such as a bottle 56, shown in phantom in FIG. 1. Preferably, the closure cap 54 is integral with the housing 22 and is configured for a snap fit onto the neck 58 of the bottle 56. Alternatively, the closure cap is rotatably coupled to the housing and has a threaded interior surface for receiving a threaded neck of a bottle.

The seal assembly 34 is preferably a single unitary piece and is of a resilient, flexible polymeric material, such as low density polyethylene (LDPE). Preferably, it has a durometer hardness reading less than that of the housing. It has a generally disc-shaped lower (first) portion 60 and a generally tubular-shaped upper (second) portion 62 extending up from the lower portion. The disc-shaped lower portion 60 functions as a gasket and is shaped and configured for preventing leakage between the closure cap 54 and the mouth of the bottle 56 when the closure cap is connected to the neck 58 of the bottle. Preferably, the disc-shaped lower portion 60 includes a downwardly extending annular lip 64 sized for sealing the inner circumference of the mouth of the bottle 56, and an outwardly extending annular flange 66 sized for sealing the upper rim of the bottle's neck 58.

Figure 2:
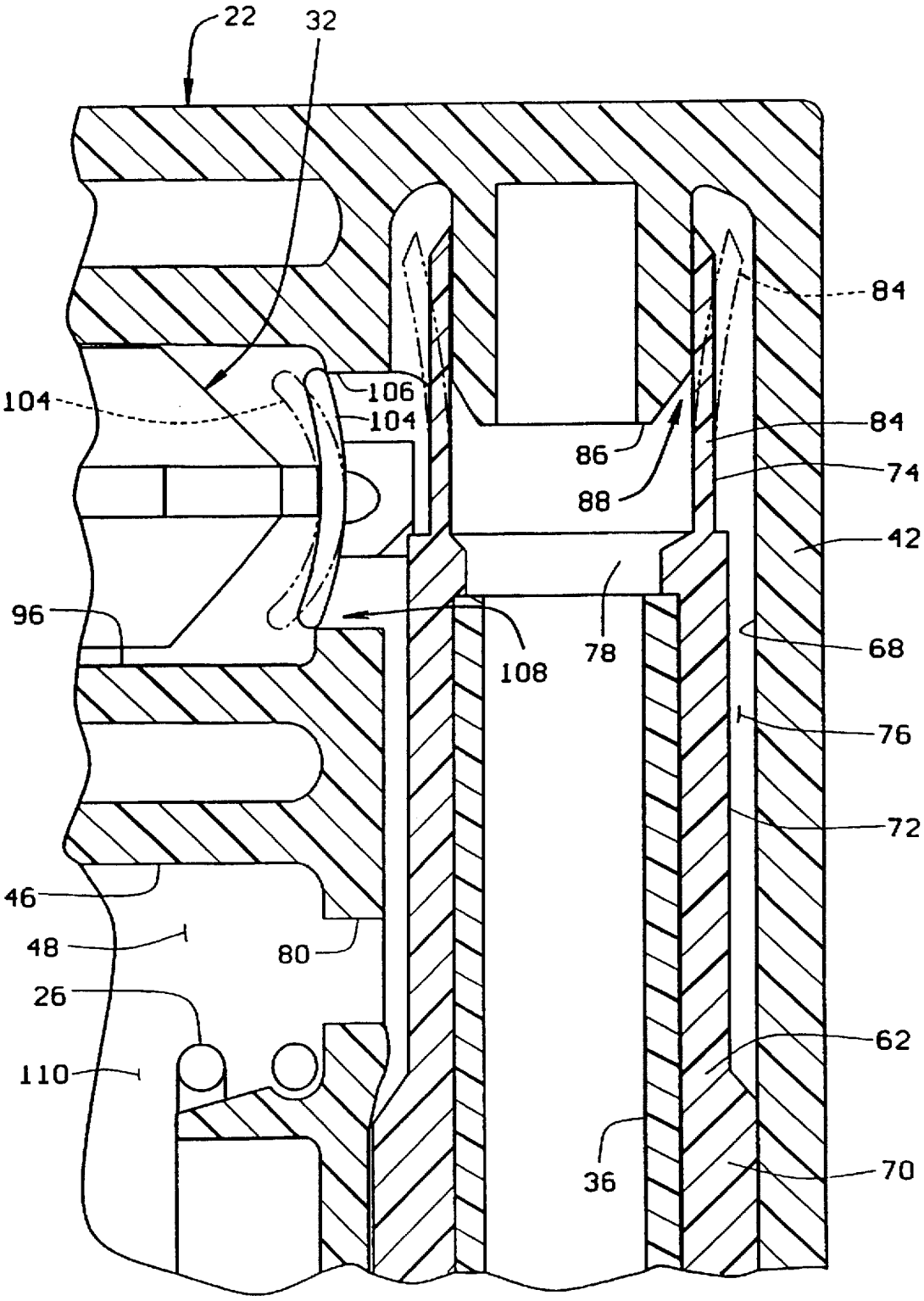
FIG. 2 is an enlarged fragmented side elevation view, in section, of the trigger sprayer of FIG. 1.

The generally tubular-shaped upper portion 62 of the seal assembly 34 extends upward into a vertical bore 68 of the vertical formation 42 of the housing 22. Preferably, the tubular-shaped upper portion 62 has a lower region 70, an intermediate region 72, and an upper region 74. The lower region 70 of the seal upper portion 62 is sized for a snug fit in the vertical bore 68 of the vertical formation 42 to provide a fluid tight seal therebetween. The intermediate region 72 has an outer diameter which is less than the inner diameter of the housing vertical bore 68. The outer surface of the intermediate region 72 and the surface of the housing vertical bore 68 define an annular fluid passage 76 (FIG. 2) therebetween. Preferably, the inside diameter of the lower and intermediate regions 70, 72 of the seal upper portion 62 are sized for a snug fit of the upper portion of the dip tube 36.

The dip tube 36 stiffens the lower and intermediate regions 70, 72 of the seal upper portion 62 to prevent them from flexing radially inwardly. Preferably, a circumferential rib 78 is on the inside of the intermediate region 72 to engage the upper end of the dip tube 36. The circumferential rib 78 defines an intake port (also referred to by reference number 78) of the trigger sprayer 20. The intake port 78 is in fluid communication with liquid (not shown) contained in the bottle 56 via the dip tube 36.

The housing 22 further includes a lateral opening extending through its circular back wall 40. Preferably, the lateral opening 80 is aligned with the intermediate region 72 of the seal upper portion 62 for providing fluid communication between the pump chamber 48 and the annular fluid passage 76. The upper region 74 of the seal upper portion 62, the annular fluid passage 76, and the lateral opening 80 define an intake liquid flow path providing fluid communication between the intake port 78 and the pump mechanism 52.

The upper region 74 of the seal upper portion 62 has a relatively thin, resilient, tubular wall 84 configured for sealingly engaging a downwardly extending protrusion 86 of the housing 22. Preferably, the protrusion 86 is generally circular in transverse cross-section. The tubular-shaped wall 84 and the protrusion 86 constitute a priming check valve 88 in the intake liquid flow path for permitting fluid flow from the intake port 78 to the pump mechanism 52 and for checking fluid flow from the pump mechanism to the intake port. In particular, the tubular wall 84 of the seal upper portion 62 comprises a moveable valve member (also referred to via reference numeral 84) of the priming check valve 88 and the protrusion 86 of the housing 22 constitutes a valve seat (also referred to via reference numeral 86) of the priming check valve. The moveable valve member 84 is moveable between a closed position (shown in solid in FIG. 2) and an open position (shown in phantom in FIG. 2). In its closed (or seated) position, the moveable valve member 84 sealing engages the protrusion 86 all around the protrusion to prevent passage of liquid therethrough. In its open (unseated) position, at least a part of the moveable valve member 84 flexes generally radially outwardly away from the protrusion 86 to thereby provide a gap between the moveable valve member and the protrusion to allow liquid to flow therethrough.

Referring again to FIG. 1, the housing 22 further includes a downwardly protruding connector 90 extending through the seal lower portion 60 to secure the seal assembly 34 to the housing. The connector 90 prevents the seal assembly 34 from falling out of or being pried from the closure cap 54. A vent bore (or opening) 92 extends through the connector 90 for providing fluid communication between atmosphere and the interior of the bottle 56 when the closure cap 54 closes the mouth of the bottle. Thus, the connector 90 serves the dual function of securing the seal assembly 34 to the housing 22 and of providing a conduit to vent the inside of the bottle 56.

The plunger 24 further includes a plug 94 integrally connected to and moveable with the piston head 50. The plug 94 is adapted for closing the bottle 56 vent opening 92 when the trigger sprayer 20 is not in use, to prevent liquid from spilling out of the bottle via the opening.

The horizontal tubular portion 44 of the housing 22 includes a horizontal bore 96 extending horizontally between a rear portion and a forward end (left end as viewed in FIG. 1) of the housing. The nozzle assembly 30 includes a tubular projection 98 inserted into the horizontal bore 96 via the forward (downstream) end of the bore, a nozzle wall 100 at a forward end of the nozzle tubular projection, and a nozzle orifice 102 through the nozzle wall and in fluid communication with the interior of the bore. The annular fluid passage 76, the horizontal bore 96, and the interior of the nozzle tubular projection 98 constitute a discharge liquid flow path. The nozzle orifice 102 constitutes a discharge port (also referred to via reference numeral 102) of the discharge liquid flow path. Dispensed liquid flows from the pump chamber 48, through the lateral opening 80, upward through the annular fluid passage 76, forward through the horizontal bore 96, and then out through the discharge port 102.

The spinner assembly 32 is positioned in the housing's horizontal bore 96 and is held in place by the nozzle tubular projection 98. The spinner assembly 32 includes a resilient disc 104 at its rearward end (right end as viewed in FIG. 1). The resilient disc 104 is engageable with an annular shoulder 106 formed in the housing 22 at the rear end of the horizontal bore 96. The resilient disc 104 and the annular shoulder 106 constitute a discharge check valve, generally indicated at 108, in the discharge liquid flow path for permitting fluid flow from the pump mechanism 52 to the nozzle discharge port 102 and for checking fluid flow from the discharge port 102 to the pump mechanism. In particular, the resilient disc 104 of the spinner assembly 32 constitutes a moveable valve member of the discharge check valve 108 and the annular shoulder 106 of the housing 22 constitutes a valve seat of the discharge check valve. The resilient disc 104 is moveable between a closed position (shown in solid in FIG. 2) and an open position (shown in phantom in FIG. 2). In its closed (or seated) position, the resilient disc 104 sealing engages the annular shoulder 106 all around the shoulder to prevent passage of liquid therethrough. In its open (unseated) position, at least a part of the resilient disc 104 flexes forwardly away from the annular shoulder 106 to thereby provide a gap between the resilient disc and the shoulder to allow liquid to flow therethrough.

The piston head 50 of the plunger 24 is preferably formed of a suitable resilient material such as low density polyethylene. The piston head 50 comprises the rearward end (the right most end as viewed in FIG. 1) of the plunger 24. The piston head 50 is slidable within the pump chamber 48 and configured for sealing engagement with the cylindric inner surface 46 of the pump chamber 48 all around the piston head 50 to seal against leakage of fluid between the plunger 24 and cylindric inner surface 46 of the housing 22. The piston head 50 and pump chamber 48 define a variable volume fluid receiving cavity 110. The piston head 50 is reciprocally slidable in the pump chamber 48 between a forward (extended) position and a rearward (compressed) position. The plunger 24 is manually moved from its extended position to its compressed position by depressing the trigger 28. The coil spring 26 is positioned between the circular back wall 40 of the pump chamber 48 and the plunger 24 for urging the plunger forward to its extended position. Thus, the plunger 24 is rearwardly moved from its extended position to its compressed position by manually squeezing the trigger 28, and is automatically returned to its extended position via the piston spring 26 when the operator releases the trigger.

In use, the trigger sprayer 20 is connected to the neck 58 of the bottle 56 via the closure cap 54. The lower portion 60 of the seal assembly 34 provides a fluid tight seal between the bottle 56 and closure cap 54 to prevent leakage of fluid therebetween. To dispense liquid, a user repeatedly squeezes and releases the trigger 28. Forward movement of the piston head 50 creates a vacuum pressure in the pump fluid receiving cavity 110 and in the annular fluid passage 76. This vacuum causes the moveable member 84 of the priming check valve 88 (i.e., the upper region 74 of the seal upper portion 62) to move radially outwardly away from the housing protrusion 86 to open the check valve and draws liquid from the bottle 56 into the fluid receiving cavity via the dip tube 36 and intake liquid flow path. Rearward movement of the piston head 50 moves the moveable member 84 of the priming check valve 88 to its seated position and unseats the resilient disc 104 of the discharge check valve 108 to permit pressurized delivery of the liquid through the discharge port 102 via the discharge liquid flow path.

Because the moveable valve member 84 of the priming check valve 88 comprises a part of the seal assembly 34, and because the moveable valve member (i.e., resilient disc 104) of the discharge check valve 108 comprises a part of the spinner assembly 32, the number of parts of the trigger sprayer 20 is less than that of conventional trigger sprayers. Thus, the cost of manufacturing the trigger sprayer 20 is less than that of conventional trigger sprayers. Also, because the housing connector 90 prevents the seal assembly 34 from falling out of or being pried from the closure cap 54, the reliability of the trigger sprayer 20 is increased. Therefore, the present invention results in a reliable, low cost liquid dispenser.

Although the preferred embodiment has been described as a trigger sprayer, it is to be understood that other pump-type dispensers (e.g., lotion dispensers, etc.) are also encompassed by this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A manually operated reciprocating fluid pump adapted to be secured to a container's mouth, said fluid pump comprising:

a dispenser body having a pump mechanism, a discharge port, and a discharge liquid flow path providing fluid communication between the pump mechanism and discharge port;

a closure cap connected to the dispenser body and configured for closing the mouth of the container, the closure cap and dispenser body being of a single unitary piece;

a seal assembly having a first portion and a second portion, said first portion being engageable with the container and shaped and configured for providing a fluid-tight seal between the closure cap and the mouth of the container when the closure cap closes the mouth of the container, said second portion having an intake port adapted for fluid communication with liquid contained in the container, the second portion of the seal assembly and the dispenser body defining an intake liquid flow path providing fluid communication between the intake port and the pump mechanism; and a check valve in the intake liquid flow path configured for permitting fluid flow from the intake port to the pump mechanism and for checking fluid flow from the pump mechanism to the intake port, said second portion of the seal assembly comprising at least part of the check valve.

2. A manually operated reciprocating fluid pump as set forth in claim 1 further comprising a dip tube depending from the second portion of the seal assembly, the dip tube being configured for conveying fluid through the intake port of said second portion of the seal assembly.

3. A fluid pump as set forth in claim 1 wherein the check valve comprises a valve seat and a moveable valve member, said moveable valve member being moveable between a closed position in which the moveable valve member is seated against the valve seat and an open position in which at least a portion of the moveable valve member is spaced from the valve seat, the second portion of the seal assembly comprising one of the valve seat and the moveable valve member.

4. A fluid pump as set forth in claim 3 wherein the dispenser body further comprises the other of said valve seat and the moveable valve member.

5. A fluid pump as set forth in claim 1 wherein the seal assembly is a single unitary piece.

6. A manually operated reciprocating fluid pump adapted to be secured to a container's mouth, said fluid pump comprising:

a dispenser body having a pump mechanism, a discharge port, and a discharge liquid flow path providing fluid communication between the pump mechanism and discharge port;

a closure cap connected to the dispenser body and configured for closing the mouth of the container;

a seal assembly having a first portion and a second portion, said first portion being engageable with the container and shaped and configured for providing a fluid-tight seal between the closure cap and the mouth of the container when the closure cap closes the mouth of the container, said second portion having an intake port adapted for fluid communication with liquid contained in the container, the second portion of the seal assembly and the dispenser body defining an intake liquid flow path providing fluid communication between the intake port and the pump mechanism; and a check valve in the intake liquid flow path configured for permitting fluid flow from the intake port to the pump mechanism and for checking fluid flow from the pump mechanism to the intake port, the check valve comprising a valve seat and a moveable valve member, said moveable valve member being moveable between a closed position in which the moveable valve member is seated against the valve seat and an open position in which at least a portion of the moveable valve member is spaced from the valve seat, the second portion of the seal assembly comprising one of the valve seat and the moveable valve member, the dispenser body further comprising the other of said valve seat and the moveable valve member.

7. A fluid pump as set forth in claim 6 wherein the second portion of the seal assembly comprises the moveable valve member of the check valve and the dispenser body comprises the valve seat of the check valve.

8. A fluid pump as set forth in claim 7 wherein the valve seat of the check valve comprises a protrusion of the dispenser body and wherein the moveable valve member of the check valve is a resilient tubular portion of the seal assembly configured for sealingly engaging the protrusion all around the tubular portion when the check valve is closed and configured so that at least a part of the tubular portion flexes generally radially outwardly away from the protrusion to thereby provide a gap between the tubular portion and protrusion when the check valve is open.

9. A pump as set forth in claim 8 wherein the protrusion is generally circular in transverse cross-section.

10. A manually operated reciprocating fluid pump adapted to be secured to a container's mouth, said fluid pump comprising:

a dispenser body having a pump mechanism, a discharge port, and a discharge liquid flow path providing fluid communication between the pump mechanism and discharge port;

a closure cap connected to the dispenser body and configured for closing the mouth of the container;

a seal assembly having a first portion and a second portion, said first portion being engageable with the container and shaped and configured for providing a fluid-tight seal between the closure cap and the mouth of the container when the closure cap closes the mouth of the container, said second portion having an intake port adapted for fluid communication with liquid contained in the container, the second portion of the seal assembly and the dispenser body defining an intake liquid flow path providing fluid communication between the intake port and the pump mechanism; and a check valve in the intake liquid flow path configured for permitting fluid flow from the intake port to the pump mechanism and for checking fluid flow from the pump mechanism to the intake port, said second portion of the seal assembly comprising at least part of the check valve;

the first portion of the seal assembly having a durometer hardness reading less than that of the closure cap, the second portion of the seal assembly having a durometer hardness reading less than that of the closure cap.

11. A fluid pump as set forth in claim 10 wherein the seal assembly is a single unitary piece.

12. A manually operated reciprocating fluid pump adapted to be secured to a container's mouth, said fluid pump comprising:

a dispenser body having a pump mechanism, a discharge port, and a discharge liquid flow path providing fluid communication between the pump mechanism and discharge port;

a closure cap connected to the dispenser body and configured for closing the mouth of the container;

a seal assembly having a first portion engageable with the container and shaped and configured for preventing leakage between the closure cap and the mouth of the container when the closure cap closes the mouth of the container; and a connector securing at least the first portion of the seal assembly to the dispenser body, said connector having a vent opening therethrough configured for providing fluid communication between atmosphere and the interior of the container when the closure cap closes the mouth of the container.

13. A fluid pump as set forth in claim 12 wherein the connector comprises a protrusion depending from the dispenser body and extending through the seal assembly, said vent opening comprising a bore extending through the protrusion.

14. A fluid pump as set forth in claim 13 wherein the seal assembly further comprises a second portion having an intake port adapted for fluid communication with liquid contained in the container, and wherein the second portion of the seal assembly and the dispenser body define an intake liquid flow path providing fluid communication between the intake port and the pump mechanism.

15. A fluid pump as set forth in claim 14 further comprising a check valve in the intake liquid flow path configured for permitting fluid flow from the intake port to the pump mechanism and for checking fluid flow from the pump mechanism to the intake port, said second portion of the seal assembly comprising at least part of the check valve.

16. A fluid pump as set forth in claim 15 wherein the seal assembly is a single unitary piece, the seal assembly having a durometer hardness reading which is less than that of the closure cap.

17. A fluid pump as set forth in claim 16 wherein the check valve comprises a valve seat and a moveable valve member, said moveable valve member being moveable between a closed position in which the moveable valve member is seated against the valve seat and an open position in which at least a portion of the moveable valve member is spaced from the valve seat, the second portion of the seal assembly comprising one of the valve seat and the moveable valve member.

18. A fluid pump as set forth in claim 17 wherein the second portion of the seal assembly comprises the moveable valve member of the check valve and the dispenser body comprises the valve seat of the check valve.

19. A fluid pump as set forth in claim 18 wherein the valve seat of the check valve comprises a protrusion of the dispenser body and wherein the moveable valve member of the check valve is a resilient tubular portion of the seal assembly configured for sealingly engaging the protrusion all around the tubular portion when the check valve is closed and configured so that at least a part of the tubular portion flexes generally radially outwardly away from the protrusion to thereby provide a gap between the tubular portion and protrusion when the check valve is open.

20. A pump as set forth in claim 19 wherein the protrusion is generally circular in transverse cross-section.

21. A manually operated reciprocating fluid pump adapted to be secured to a container's mouth, said fluid pump comprising:

a dispenser body having a pump mechanism, a discharge port, and a discharge liquid flow path providing fluid communication between the pump mechanism and discharge port;

a closure cap connected to the dispenser body and configured for closing the mouth of the container;

a seal assembly having a first portion and a second portion, said first portion being engageable with the container and shaped and configured for providing a fluid-tight seal between the closure cap and the mouth of the container when the closure cap closes the mouth of the container, said second portion having an intake port adapted for fluid communication with liquid contained in the container, the second portion of the seal assembly and the dispenser body defining an intake liquid flow path providing fluid communication between the intake port and the pump mechanism;

a check valve in the intake liquid flow path configured for permitting fluid flow from the intake port to the pump mechanism and for checking fluid flow from the pump mechanism to the intake port, said second portion of the seal assembly comprising at least part of the check valve; and a connector securing the seal assembly to the dispenser body, said connector having a vent opening therethrough configured for providing fluid communication between atmosphere and the interior of the container when the closure cap closes the mouth of the container.

22. A fluid pump as set forth in claim 21 wherein the connector comprises a protrusion depending from the dispenser body and extending through the seal assembly, said vent opening comprising a bore extending through the protrusion.

23. A fluid pump as set forth in claim 21 wherein the seal assembly is a single unitary piece.

* * * * *

US005794822C1

(12) EX PARTE REEXAMINATION CERTIFICATE (6295th)

United States Patent

Foster

(10) Number: US 5,794,822 C1

(45) Certificate Issued: Jul. 15, 2008

(54) RECIPROCATING FLUID PUMP WITH IMPROVED BOTTLE SEAL

(75) Inventor: Donald D. Foster, St. Charles, MO (US)

(73) Assignee: Continental Sprayers International, Inc., St. Peters, MO (US)

Reexamination Request:
No. 90/008,872, Oct. 9, 2007

Reexamination Certificate for:

| | |
|---|---|
| Patent No.: | **5,794,822** |
| Issued: | **Aug. 18, 1998** |
| Appl. No.: | **08/633,894** |
| Filed: | **Apr. 17, 1996** |

(51) Int. Cl.
*B67D 5/40* (2006.01)

(52) U.S. Cl. ..... 222/383.1

(58) Field of Classification Search ..... 222/383.1
See application file for complete search history.

(56) References Cited

U.S. PATENT DOCUMENTS 4,728,009 A 3/1988 Schmidt

*Primary Examiner*—Joseph A. Kaufman

(57) ABSTRACT

A manually operated reciprocating fluid pump for securement to a container's mouth. The fluid pump comprises a dispenser body, a closure cap, a seal assembly, and a priming check valve. The dispenser body has a pump mechanism, a discharge port, and a discharge liquid flow path providing fluid communication between the pump mechanism and discharge port. The closure cap is connected to the dispenser body and is configured for closing the mouth of the container. The seal assembly has a first portion and a second portion. The first portion is shaped and configured for preventing leakage between the closure cap and the mouth of the container when the closure cap closes the mouth of the container. The second portion has an intake port adapted for fluid communication with liquid contained in the container. The second portion of the seal assembly and the dispenser body define an intake liquid flow path providing fluid communication between the intake port and the pump mechanism. A check valve in the intake liquid flow path is configured for permitting fluid flow from the intake port to the pump mechanism and for checking fluid flow from the pump mechanism to the intake port. The second portion of the seal assembly comprises at least part of the check valve.

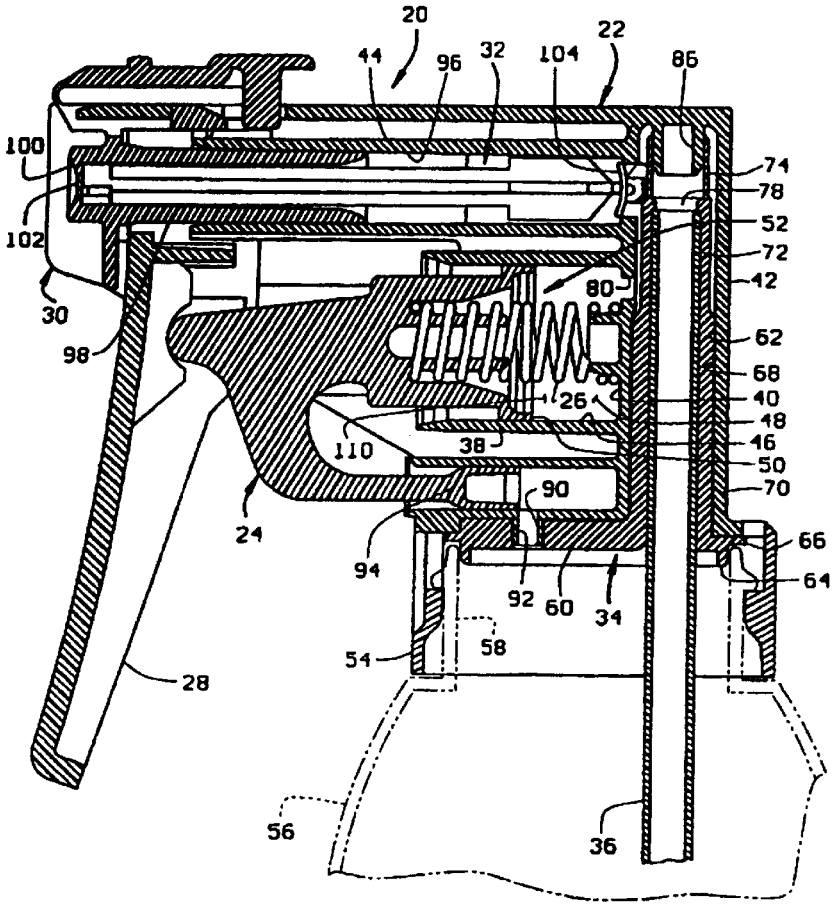

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 12 is determined to be patentable as amended.

New claims 24–29 are added and determined to be patentable.

Claims 1–11 and 13–23 were not reexamined.

12. A manually operated reciprocating fluid pump adapted to be secured to a container's mouth, said fluid pump comprising:

a dispenser body having a pump mechanism, a discharge port, and a discharge liquid flow path providing fluid communication between the pump mechanism and discharge port;

a closure cap connected to the dispenser body and configured for closing the mouth of the container;

a seal assembly having a first portion engagable with the container and shaped and configured for preventing leakage between the closure cap and the mouth of the container when the closure cap closes the mouth of the container*, the seal assembly first portion having an annular lip that is sized for sealing engagement inside the mouth of the container when the closure cap closes the mouth of the container*; and a connector securing at least the first portion of the seal assembly to the dispenser body, said connector having a vent opening therethrough configured for providing fluid communication between atmosphere and the interior of the container when the closure cap closes the mouth of the container.

*24. A fluid pump as set forth in claim 12 wherein the seal assembly includes a second portion, the second portion of the seal assembly defining an intake liquid flow path providing fluid communication with the pump mechanism.*

*25. A fluid pump as set forth in claim 24 wherein a check valve is provided in the intake liquid flow path, the check valve being configured for permitting fluid flow through the intake liquid flow path to the pump mechanism and for checking fluid flow from the pump mechanism to the intake liquid flow path, the check valve comprising a valve seat and a movable valve member, said movable valve member being movable between a closed position in which the movable valve member is seated against the valve seat and an open position in which at least a portion of the movable valve member is spaced from the valve seat, and the second portion of the seal assembly comprising at least one of the valve seat and the movable valve member.*

*26. A fluid pump as set forth in claim 25 wherein the movable valve member is resiliently flexible between the closed position and the open position.*

*27. A fluid pump as set forth in claim 26 wherein the movable valve member extends from and is part of the second portion of the seal assembly.*

*28. A fluid pump as set forth in claim 24 wherein the seal assembly is a single unitary piece.*

*29. A fluid pump a set forth in claim 24 wherein a dip tube is in fluid communication with the second portion of the seal assembly.*

* * * * *